US008495831B1

(12) United States Patent
Kohout

(10) Patent No.: US 8,495,831 B1
(45) Date of Patent: Jul. 30, 2013

(54) TWO SHOT PISTOL

(75) Inventor: Raymond B. Kohout, Lake Ozark, MO (US)

(73) Assignee: Doubletap Defense, LLC, St. Louis, MO (US)

( * ) Notice: Subject to any disclaimer, the term of this patent is extended or adjusted under 35 U.S.C. 154(b) by 20 days.

(21) Appl. No.: 13/333,513

(22) Filed: Dec. 21, 2011

Related U.S. Application Data

(60) Provisional application No. 61/426,458, filed on Dec. 22, 2010.

(51) Int. Cl.
*F41A 3/58* (2006.01)
*F41A 19/22* (2006.01)
*F41A 19/18* (2006.01)

(52) U.S. Cl.
USPC ..... 42/8; 42/42.03; 42/69.01

(58) Field of Classification Search
USPC ..... 42/8, 40, 41, 42.03, 46, 69.01
See application file for complete search history.

(56) References Cited

U.S. PATENT DOCUMENTS

| | | | | | |
|---|---|---|---|---|---|
| 239,662 | A | * | 4/1881 | Martin | 42/8 |
| 325,053 | A | * | 8/1885 | Chuchu | 42/8 |
| 1,348,035 | A | * | 7/1920 | Mossberg | 42/8 |
| 1,637,079 | A | * | 7/1927 | Karner, Jr. | 42/69.01 |
| D121,317 | S | | 7/1940 | Dimick | |
| 2,509,553 | A | | 5/1950 | Wylie | |
| 2,805,507 | A | | 9/1957 | Buquor | |
| 3,193,960 | A | * | 7/1965 | Stevens, Jr. | 42/8 |
| 3,209,480 | A | * | 10/1965 | Mittelseadt | 42/70.08 |
| 3,352,046 | A | * | 11/1967 | Warner et al. | 42/106 |
| 3,597,870 | A | * | 8/1971 | Block | 42/42.01 |
| 3,722,125 | A | | 3/1973 | Switzer | |
| D251,913 | S | | 5/1979 | Romano | |
| 4,155,187 | A | | 5/1979 | Lichtman | |
| D263,413 | S | | 3/1982 | Hillberg | |
| 4,400,900 | A | * | 8/1983 | Hillberg et al. | 42/69.01 |
| 4,416,078 | A | * | 11/1983 | Hillberg | 42/69.01 |

(Continued)

OTHER PUBLICATIONS

Additional Counterclaim Defendants Ray Kohout and Marvin Dufner's Reply to Defendant's Verified Counterclaim and Plaintiff's First Amended Reply to Defendants' Verified Counterclaim, *Doubletap Defense LLC, f/k/a Heizer Technologies, LLC, and Central Holding Corp., a Missouri corporation* v.*Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No.

(Continued)

*Primary Examiner* — Bret Hayes
(74) *Attorney, Agent, or Firm* — Foley & Lardner LLP; Joseph Teja, Jr.; Moses A. Heyward

(57) ABSTRACT

A small, lightweight multi-shot pistol, preferably includes a readily field removable receiver having two barrels in an over/under configuration. The butt of the pistol includes a storage chamber holding two spare cartridges. The single trigger is a double action trigger. The configuration of the pistol is such that two shots may be rapidly fired in a "double tap" manner, and the receiver can then be released using a thumb latch, whereby the receiver will be tilted upward and an auto-ejector will eject the spent cartridges. The spare cartridges are held together using a speed loader device which holds them so that they are properly aligned for speedy insertion into the breach of the tilted receiver.

14 Claims, 3 Drawing Sheets

U.S. PATENT DOCUMENTS

| | | | | | |
|---|---|---|---|---|---|
| D274,639 | S | | 7/1984 | Seminiano | |
| 4,489,515 | A | * | 12/1984 | Numbers | 42/70.01 |
| 4,625,443 | A | * | 12/1986 | Beretta | 42/42.03 |
| 4,646,458 | A | * | 3/1987 | Stevens | 42/46 |
| 4,697,368 | A | | 10/1987 | Williams | |
| 4,722,148 | A | * | 2/1988 | Walker | 42/69.01 |
| 5,225,611 | A | * | 7/1993 | Scott | 42/42.03 |
| 5,421,114 | A | * | 6/1995 | Bond et al. | 42/42.03 |
| D400,633 | S | | 11/1998 | Chapman | |
| 6,854,205 | B2 | | 2/2005 | Wikle et al. | |
| D651,275 | S | | 12/2011 | Emde et al. | |
| 2010/0139144 | A1 | | 6/2010 | Fitzpatrick et al. | |
| 2011/0072704 | A1 | * | 3/2011 | Teach et al. | 42/8 |
| 2013/0104436 | A1 | | 5/2013 | Heizer | |

OTHER PUBLICATIONS

Charles K. Heizers Objections and Answers to Plaintiffs First Interrogatories to Defendant Charles K. Heizer, Doubletap Defense LLC, et al., Heizer Aerospace, Inc., et al., Case No. 13SL-CC00012, Division No. 16, Feb. 19, 2013 (40 pages).

Charles K. Heizers' Objections and Responses to Plaintiffs' First Request for Production of Documents to Defendant Charles K. Heizer, Doubletap Defense LLC, et al., Heizer Aerospace, Inc., et al., Case No. 13SL-CC00012, Division No. 16, Feb. 19, 2013 (32 pages).

Consent Order, Doubletap Defense LLC, et al.,Plaintiffs/Counterclaim Defendants, Heizer Aerospace, Inc., et al., Defendants/Counterclaim Plaintiffs, Case No. 13SL-CC00012, Division No. 16, Jan. 14, 2013(2 pages).

Defendant Heizer Aerospace Inc.'s Objections and Answers to Plaintiffs First Interrogatories to Defendant Heizer Aerospace Inc., *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Feb. 19, 2013(39 pages).

Defendant Heizer Defense, LLC's Objections and Answers to Plaintiffs First Interrogatories to Defendant Heizer Defense, LLC, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Feb. 19, 2013 (40 pages).

Defendants' Memorandum in Opposition to Plaintiffs Motion for Temporary Restraining Order, Doubletap Defense LLC, et al., Plaintiffs/Counterclaim Defendants, Heizer Aerospace, Inc., et al., Defendants/Counterclaim Plaintiffs, Case No. 13SL-CC00012, Division No. 16, Jan. 9, 2013(44 pages).

Defendants/Counterclaim Plaintiffs First Request for Production of Documents Directed to Plaintiffs/Counterclaim Defendants and Additional Counterclaim Defendants, Doubletap Defense LLC, et al., Plaintiffs/Counterclaim Defendants, Heizer Aerospace, Inc., et al., Defendants/Counterclaim Plaintiffs, Case No. 13SL-CC00012, Division No. 16, Jan. 25, 2013(13 pages).

Defendants/Counterclaim Plaintiffs First Set of Interrogatories Directed to Plaintiffs/Counterclaim Defendants and Additional Counterclaim Defendants, Doubletap Defense LLC, et al., Plaintiffs/Counterclaim Defendants, Heizer Aerospace, Inc., et al., Defendants/Counterclaim Plaintiffs, Case No. 13SL-CC00012, Division No. 16, Jan. 25, 2013 (11 pages).

Defendants/Counterclaim Plaintiffs Motion to Dismiss Counts III, IV, VI and VII of Plaintiffs/Counterclaim Defendants Verified Petition, Doubletap Defense LLC, et al., Plaintiffs/Counterclaim Defendants, Heizer Aerospace, Inc., et al., Defendants/Counterclaim Plaintiffs, Case No. 13SL-CC00012, Division No. 16, Feb. 19, 2013 (15 pages).

Entry of Appearance, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Jan. 9, 2013 (2 pages).

Entry of Appearance, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Feb. 21, 2013 (5 pages).

Hedy Heizer Gahn's Objections and Responses to Plaintiffs' First Request for Production of Documents to Defendant Hedy Heizer, *Doubletap Defense LLC, et al., Plaintiffs* v. *Heizer Aerospace, Inc., et al., Defendants*, Case No. 13SL-CC00012, Division No. 16, Feb. 19, 2013(31 pages).

Hedy Heizer Gahn's Objections and Answer to Plaintiffs First Interrogatories to Defendant Hedy Heizer Gahn, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Feb. 19, 2013 (40 pages).

Heizer Aerospace Inc. Presentation at Jan. 9, 2013 Hearing (26 pages).

Heizer Aerospace Inc.'s Objections and Responses to Plaintiffs First Request for Production of Documents to Defendant Heizer Aerospace Inc., *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Feb. 19, 2013 (31 pages).

Heizer Defense, LLC's Objections and Responses to Plaintiffs First Request for Production of Documents to Defendant Heizer Defense, LLC, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Feb. 19, 2013 (32 pages).

James Bruchas' Objections and Answer to Plaintiffs First Interrogatories to Defendant James Bruchas, *Doubletap Defense LLC, et al., Plaintiffs* v. *Heizer Aerospace, Inc., et al., Defendants*, Case No. 13SL-CC00012, Division No. 16, Feb. 19, 2013 (17 pages).

James Bruchas' Objections and Responses to Plaintiffs First Request for Production of Documents to Defendant James Bruchas, *Doubletap Defense LLC, et al., Plaintiffs* v. *Heizer Aerospace, Inc., et al., Defendants*, Case No. 13SL-CC00012, Division No. 16, Feb. 19, 2013 (14 pages).

Memorandum, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 10, 2013 (18 pages).

Memorandum, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 10, 2013 (28 pages).

Memorandum, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 11, 2013 (3 pages).

Motion to Disqualify Attorney Robert J. Kaufman, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Jan. 9, 2013 (5 pages).

Motion to Expedite Discovery, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Jan. 11, 2013 (4 pages).

Motion to Quash Subpoenas and for Protective Order, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Jan. 11, 2013 (43 pages).

Notice of Hearing re Motion to Disqualify, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 22, 2013 (5 pages).

Notice of Hearing, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 4, 2013 (4 pages).

Order Hearing on Temporary Restraining Order, *Doubletap Defense LLC, et al., Plaintiffs* v. *Heizer Aerospace, Inc., et al., Defendants*, Case No. 13SL-CC00012, Division No. 16, Jan. 3, 2013 (2 pages).

Order, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 4, 2013 (3 pages).

Plaintiffs' First Interrogatories to Defendant Charles K. Heizer, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (24 pages).

Plaintiffs' First Interrogatories to Defendant Hedy Jane Heizer-Gahn, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (24 pages).

Plaintiffs' First Interrogatories to Defendant Heizer Aerospace, Inc., *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (24 pages).

Plaintiffs' First Interrogatories to Defendant Heizer Defense, LLC, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (24 pages).

Plaintiffs' First Interrogatories to Defendant James Bruchas, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. '16, Jan. 4, 2013 (15 pages).

Plaintiffs' First Interrogatories to Defendant Rodney Mullins, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. '16, No Date (15 pages).

Plaintiffs' First Interrogatories to Defendant Thomas Heizer, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. '16, No Date (24 pages).

Plaintiffs' First Request for Production of Documents to Defendant Charles Heizer, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. '16, No Date (20 pages).

Plaintiffs' First Request for Production of Documents to Defendant Hedy Jane Heizer-Gahn, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (20 pages).

Plaintiffs' First Request for Production of Documents to Defendant James Bruchas, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (13 pages).

Plaintiffs' First Request for Production of Documents to Defendant Thomas Heizer, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (20 pages).

Plaintiffs' Motion for Expedited Discovery and to Shorten Time for Hearing of Motion, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 3, 2013 (10 pages).

Plaintiffs' Motion for Preliminary Injunction, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 2, 2013 (39 pages).

Plaintiffs' Motion for Temporary Restraining Order, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 2, 2013 (40 pages).

Plaintiffs' Reply and Affirmative Defenses to Defendants' Verified Counterclaims, *Doubletap Defense LLC, f/k/a Heizer Technologies, LLC, and Central Holding Corp., a Missouri corporation, Plaintiffs/Counterclaim Defendants,* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins, Defendants/Counterclaim Plaintiffs.* v. *Heizer Technologies, LLC, misnamed and k/n/a Doubletap Defense, LLC, and Ray Kohout, and Marvin Dufner, Counterclaim Defendants*. Case No. 13SL-CC00012, Division No. 16, Jan. 2, 2013 (22 pages).

Plaintiffs' Response in Opposition to Defendants Motion to Disqualify Attorney Robert J. Kaufman and Brief in Support, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, Jan. 23, 2013 (15 pages).

Plaintiffs'/Counterclaim Defendants Answer and Objections to Defendants/Counterclaim Plaintiffs' First Set of Interrogatories, *Doubletap Defense LLC, et al., Plaintiffs/Counterclaim Defendants* v. *Heizer Aerospace, Inc., et al., Defendants/Counterclaim Plaintiffs*, Case No. 13SL-CC00012, Division No. 16, Apr. 1, 2013 (12 pages).

Plaintiffs/Counterclaim Defendants Responses and Objections to Defendants/Counterclaim Plaintiffs First Requests for Production of Documents to Defendants/Counterclaim Plaintiffs' First Set of Interrogatories, *Doubletap Defense LLC, et al., Plaintiffs/Counterclaim*

*Defendants* v. *Heizer Aerospace, Inc., et al., Defendants/Counterclaim Plaintiffs*, Case No. 13SL-CC00012, Division No. 16, Apr. 1, 2013 (23 pages).
Plaintiffs' First Request for Production of Documents to Defendant Heizer Aerospace, Inc., *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (20 pages).
Plaintiffs' First Request for Production of Documents to Defendant Heizer Defense, LLC, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (20 pages).
Plaintiffs' First Request for Production of Documents to Defendant Rodney Mullins, *Doubletap Defense LLC, f/k/a Heizer Technologies, LLC, and Central Holding Corp., a Missouri corporation* v. *Heizer Aerospace Inc. a Missouri corporation, Heizer Defense, LLC, a Missouri Limited Liability corporation, Charles K. Heizer, Thomas Heizer, Hedy Jane Heizer-Gahn, James Bruchas, and Rodney Mullins*, Case No. 13SL-CC00012, Division No. 16, No Date (13 pages).
Request for Appointment of Process Server, *Doubletap Defense LLC, f/k/a Heizer Technologies, LLC et al.*, v. *Heizer Defense, LLC et al*, Case No. 13SL-CC00012, Division No. 16, Jan. 3, 2013 (2 pages).
Rodney Mullins' Objections and Answers to Plaintiffs' First Interrogatories to Defendant Rodney Mullins, *Doubletap Defense LLC, et al., Plaintiffs,* v. *Heizer Aerospace, Inc., et al., Defendants*, Case No. 13SL-CC00012, Division No. 16, Feb. 19, 2013 (17 pages).
Rodney Mullins' Objections and Responses to Plaintiffs' Request for Production of Documents to Defendant Rodney Mullins, *Doubletap Defense LLC, et al., Plaintiffs,* v. *Heizer Aerospace, Inc., et al., Defendants*, Case No. 13SL-CC00012, Division No. 16, Feb. 19, 2013 (14 pages).
Subpoena Directed to Charles Heizer, *Doubletap Defense LLC, et al., Plaintiffs,* v. *Heizer Aerospace, Inc., et al., Defendants*, Case No. 13SL-CC00012, Division No. 16, Jan. 11, 2013 (8 pages).
Subpoena Directed to Dennis Donohue, *Doubletap Defense LLC, et al., Plaintiffs,* v. *Heizer Aerospace, Inc., et al., Defendants*, Case No. 13SL-CC00012, Division No. 16, Jan. 11, 2013 (9 pages).
Thomas Heizer's Objections and Answers to Plaintiffs' First Interrogatories to Defendant Thomas Heizer, *Doubletap Defense LLC, et al., Plaintiffs,* v. *Heizer Aerospace, Inc., et al., Defendants*, Case No. 13SL-CC00012, Division No. 16, Feb. 19, 2013 (40 pages).
Thomas Heizer's Objections and Responses to Plaintiffs' First Request for Production of Documents to Defendant Thomas Heizer, *Doubletap Defense LLC, et al., Plaintiffs,* v. *Heizer Aerospace, Inc., et al., Defendants*, Case No. 13SL-CC00012, Division No. 16, Feb. 19, 2013 (14 pages).
US Notice of Allowance U.S. Appl. No. 29/409,263 dated Apr. 3, 2013 (8 pages).
US Office Action for U.S. Appl. No. 29/409,263 dated Dec. 19, 2012 (6 pages).
Verified Counterclaims, *Doubletap Defense LLC, f/k/a Heizer Technologies, LLC, and Central Holding Corp., Plaintiffs/Counterclaim Defendants,* v. *Heizer Aerospace Inc., Heizer Defense, LLC, Charles K. Heizer, Thomas Heizer, Hedy Jane HeizerpGahn, James Bruchas, and Rodney Mullins, Defendants/Counterclaim Plaintiffs,* v. *Heizer Technologies, LLC, Serve CT Corporation, Serve Ray Kohout, Serve Marvin Dufner*, Case No. 13SL-CC00012, Division No. 16, Jan. 8, 2013 (28 pages).
Verified Motion for Admission Pro Hac Vice, *Doubletap Defense, LLC, f/k/a Heizer Technologies, LLC, and Central Holding Corporation Plaintiffs,* v. *Heizer Aerospace Inc., Heizer Defense, LLC, Charles K. Heizer, Thomas Heizer, Hedy Jane Heizer-Gahn, James Bruchas, Rodney Mullins, Defendants*. Case No. 13SL-CC00012, Division No. 16, Jan. 2, 2013 (7 pages).
Verified Motion for Admission Pro Hac Vice, *Doubletap Defense, LLC, f/k/a Heizer Technologies, LLC, and Central Holding Corporation, a Missouri Corporation, Plaintiffs,* v. *Heizer Aerospace Inc., a Missouri limited liability corporation, Charles K. Heizer, Thomas Heizer, Hedy Jane Heizer-Gahn, James Bruchas, and Rodney Mullins, Defendants*. Case No. 13SL-CC00012, Division No. 16, Jan. 10, 2013 (5 pages).
Verified Petition for Breach of Non-Disclosure Agreement, Breach of Joint Venture Agreement, Negligent Misrepresentation, Fraud, Conversion Replevin, Defamation, Injurious Falsehood, Breach of Fiduciary Duty, Breach of the Duty of Loyalty, Temporary Restraining Order and Preliminary and Permanent Injunction, and Violation of the Missouri Trade Secrets Act, *Doubletap Defense, LLC, f/k/a Heizer Technologies, LLC, and Central Holding Corporation Plaintiffs,* v. *Heizer Aerospace Inc., Heizer Defense, LLC, Charles K. Heizer, Thomas Heizer, Hedy Jane Heizer-Gahn, James Bruchas, Rodney Mullins, Defendants*. Case No. 13SL-CC00012, Division No. 16, Jan. 2, 2013 (60 pages).
Certificate of Service, *Doubletap Defense LLC, et al.* v. *Heizer Aerospace, Inc., et al.*, Case No. 13SL- CC00012, Division No. 16, Jan. 25, 2013 (3 pages).
Certificate of Service, *Doubletap Defense LLC, et al.* v. *Heizer Aerospace, Inc., et al.*, Case No. 13SL-CC00012, Division No. 16, Apr. 1, 2013 (3 pages).
Certificate of Service, *Doubletap Defense LLC, f/k/a Heizer Technologies, LLC, and Central Holding Corp.* v. *Heizer Aerospace Inc., Heizer Defense, LLC, Charles K. Heizer, Thomas Heizer, Hedy Jane Heizer-Gahn, James Bruchas, and Rodney Mullins*, Case No. 13SL-CC00012, Division No. 16, Apr. 1, 2013 (4 pages).
Certificate of Service, *Doubletap Defense LLC. et al.* v. *Heizer Aerospace, Inc., et al.*, Case No. 13SL-CC00012, Division No. 16, Feb. 19, 2013 (3 pages).

* cited by examiner

TWO SHOT PISTOL

CROSS-REFERENCE TO RELATED APPLICATIONS

The present application is a continuation of provisional application Ser. No. 61/426,458 entitled Two Shot Pistol, filed Dec. 22, 2010, the priority of which is hereby claimed.

BACKGROUND OF THE INVENTION

The present invention relates to a very small, lightweight pistol which is able to shoot two bullets without reloading. In particular, the present invention relates to a pistol which is generally intended for use as a "back-up" or concealed carry weapon which is small and light weight, but which is designed and constructed so as to provide a two shot capability, with successive shots made by successive trigger pulls. Alternatively, both shots may be made with a single trigger pull.

Small, light weight pistols, such as those made by Derringer, have been available for many years. While such pistols included double barrel pistols, they were not designed to provide a two shot capability (a so-called "double tap" shooting technique capability) without taking action other than by making successive trigger pulls. Thus, such pistols typically required some additional action by the shooter, such as the flipping of a lever, manually cocking the hammer, or the use of two triggers, in order to provide two shot capability. Even then, once the pistols of the prior art had been discharged they were not designed to be reloaded quickly, easily, or conveniently.

The prior art also included such single shot, small, light weight pistols as the "Liberator" which was quite inexpensive to manufacture and which included space within its butt where additional rounds of ammunition could be stored. Once again, however, the design of the Liberator pistol did not permit reloading to be quick, easy, or convenient. Further, the design of the Liberator pistol was such that it included numerous parts which were not "smoothly" integrated whereby that pistol could be quickly and reliably extricated from a pocket or other concealed location without a likelihood of some portion of the pistol (e.g., a hammer) catching on the user's clothing, etc., which feature is especially important in a tactical situation.

Accordingly, there has been an ongoing need in the law enforcement and military fields for a well made, light weight, readily concealed backup or tactical weapon which could provide the user with a two shot capability, as well as being easily concealed without fear that the design would catch on the inside of a user's pocket, or other article of clothing, or other concealed location when the user needed to quickly extract the weapon in an emergent situation.

There have also been ongoing needs for a pistol which could be discharged twice in rapid succession and then quickly and reliably reloaded with available cartridges, as well as for a pistol in which the barrel assembly can be quickly and easily changed without tools, and where different barrel assemblies can be adapted for use with different caliber cartridges.

Another unmet need of the prior art has been for a pistol which could have interchangeable barrels, whereby the same pistol could be used with multiple calibers of ammunition, as desired.

SUMMARY OF THE INVENTION

The present invention is a pistol which is small, lightweight, and easily concealed. The present invention includes a single trigger which is used in a double action mode, whereby successive pulls of the trigger will result in the discharge of the two cartridges contained in the double barrel over/under configuration used in the receiver of the preferred embodiment of the invention. In many respects the present invention is similar to an over/under double barrel shotgun in that its receiver preferably has an over/under, or superposed, configuration. Further, the pistol of the present invention includes a spring-loaded cartridge ejector mechanism along with a spring loaded "thumb latch" which can be moved forward from either side of the pistol from a first "locked" position to a second "unlocked" position, whereby the receiver is released from a first "locked and loaded" position and tilted forward by a barrel tip-up spring surrounding a retainer/pivot. When the receiver is tilted forward the spent cartridges will be ejected by a spring loaded ejector mechanism, so that the breach is emptied of the spent cartridges whereby they can be quickly replaced with spare cartridges.

In accordance with the invention, the butt of the pistol preferably includes a cartridge trap adapted to hold two spare cartridges which are held together by a cartridge retention device called a "Heizer loading device" which has been designed to hold the spare cartridges in the correct juxtaposition so as to enable the user to quickly, and simultaneously, place them into the breach of the receiver. In accordance with the invention, the cartridge trap has a "trap door" at the bottom of the grip. The trap door is held closed by a detent in normal use, but it can be readily flipped open to allow the spare cartridges, which are connected together in the foregoing "Heizer loading device", to be dropped into the waiting hand of the user, who can then quickly, easily, and reliably reload the pistol by sliding the spare cartridges into the waiting breach and then removing the "Heizer loading device" into which the rear of the spare cartridges has been placed.

DETAILED DESCRIPTION OF THE EXEMPLARY EMBODIMENTS

Figure 4:
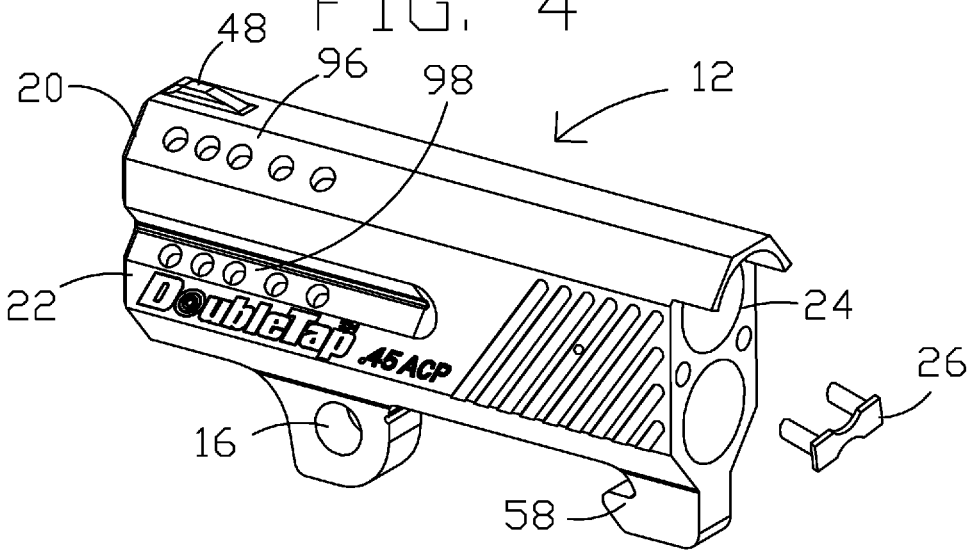
FIG. 4 is a perspective view of the barrel assembly of the pistol of the preferred embodiment of the present invention.

In accordance with the present invention a small, lightweight, two shot pistol 10 is shown in FIGS. 1-3 and 5-6. With specific reference to FIGS. 1, 5, and 6, the pistol 10 includes a removable barrel assembly or receiver 12 which can be pivoted about an axis defined by a retaining member 14 which is a pin held in place by a detent (not shown). The retaining member 14 extends through an opening 16 in the barrel assembly 12 (See, FIG. 4). It can be pushed from one side, to release it from the detent, whereby the barrel assembly 12 can be removed and replaced. A feature of the present invention is that interchangeable barrel assemblies can be used for different caliber cartridges.

Figure 1:
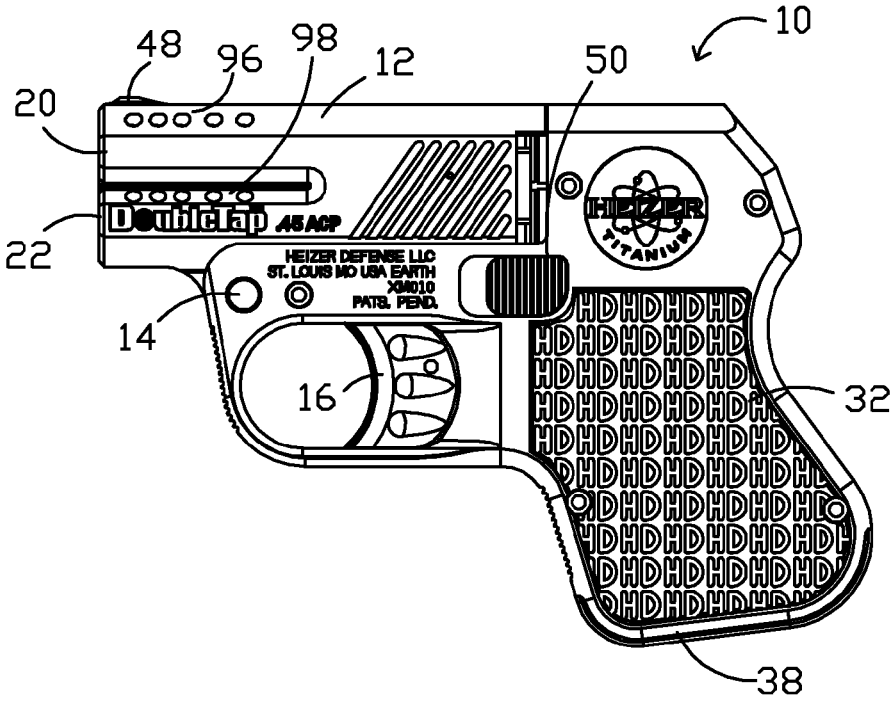
FIG. 1 is a side view of the pistol of the preferred embodiment of the present invention.
Figure 2:
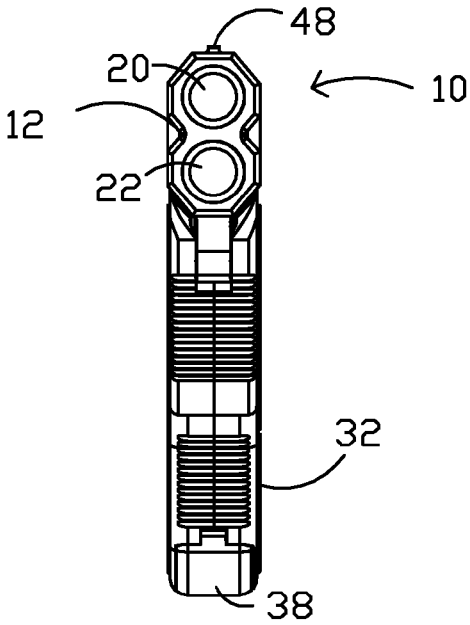
FIG. 2 is a front view (e.g., a muzzle view) of the preferred embodiment of the pistol of the preferred embodiment of the present invention looking into the barrels.
Figure 3:
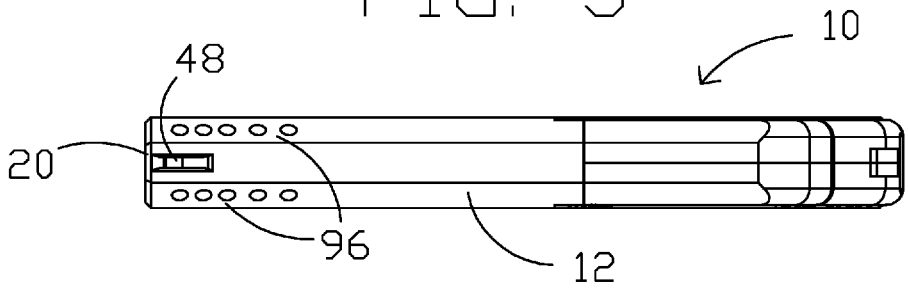
FIG. 3 is a top view of the pistol of the preferred embodiment of the present invention.
Figure 5:
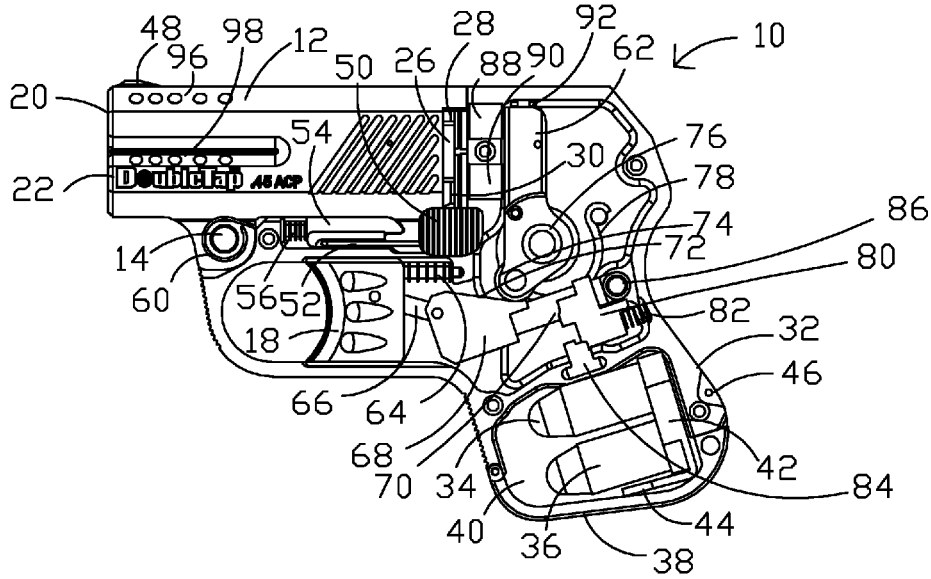
FIG. 5 is a side view cutaway view of the pistol of the preferred embodiment of the present invention.
Figure 6:
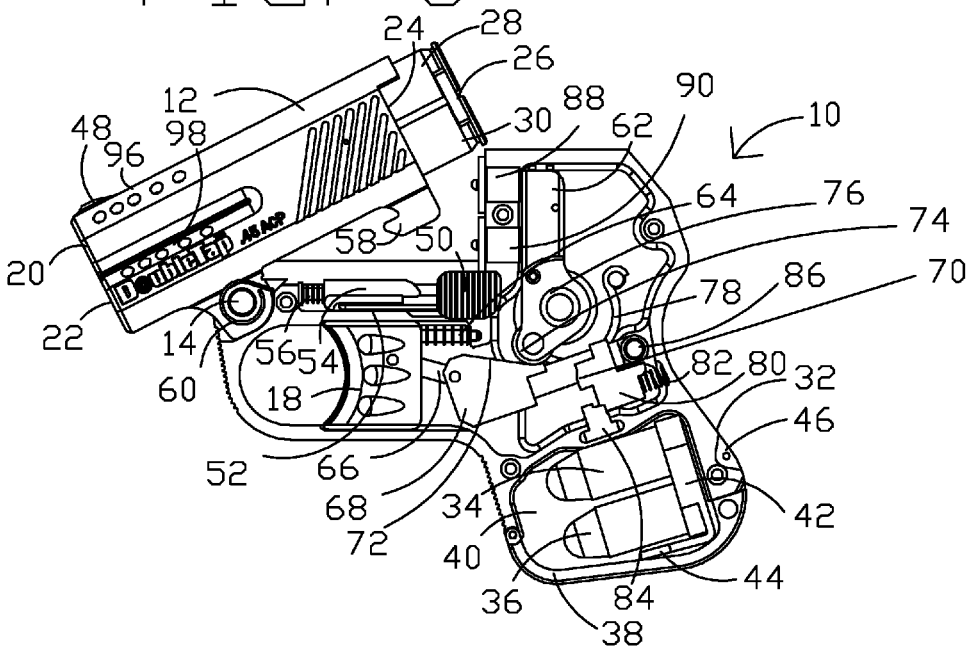
FIG. 6 is a side view cutaway view of the pistol of the preferred embodiment of the present invention with the barrel assembly in the raised position.

In accordance with the preferred embodiment of the invention, the pistol 10 includes a single trigger 18, which is preferably a double action trigger. The receiver 12 (shown in FIGS. 1-6) includes a pair of barrels which preferably have an over/under configuration, including an upper barrel 20 and a lower barrel 22, as best illustrated in FIG. 2. The breach 24 of the pistol 10 preferably includes a spring loaded auto-ejector 26 for receiving two cartridges 28, 30 which can be inserted therein when the receiver 12 is in its "tilted forward/open" position, as shown in FIG. 6.

The pistol 10 further includes a butt, or pistol grip 32 which is designed to receive a pair of spare cartridges 34, 36. In the preferred embodiment of the invention the pistol grip 32 is a machined integral grip, as it is machine processed to provide a pattern or design which emulates a texture, which may include designs or logos, as shown in FIG. 1, while being integral with the frame of the pistol 10 to minimize the thickness of the pistol 10. As shown in FIGS. 1-2 and 5-6, a trap door 38 is formed at the bottom of the grip 32. The trap door 38 pivots down from its normally closed position (shown) in order to allow the user to extract the spare cartridges 34, 36 from a cartridge trap 40 formed within the grip 32. As illustrated in FIGS. 5-6 the spare cartridges 34, 36 are press fit into a cartridge loading device 42 (the "Heizer loading device") which holds the cartridges 34, 36 in proper juxtaposition whereby they can be pressed directly into the breach 24 when the barrel assembly is tilted up as in FIG. 6. With continued reference to FIGS. 5 and 6 the cartridge loading device 42 includes a tab 44 which is bent over, as shown, when the cartridge loading device 42 is within the cartridge trap 40.

In the preferred embodiment of the invention a lanyard mount 46 is preferably included on the rear portion of the grip 32, whereby the pistol 10 may be retained by a lanyard or chain, as desired by the user.

Various features of the pistol 10 of the preferred embodiment of the invention are included in order to minimize any likelihood of catching or snagging as the user withdraws the pistol 10 from his pocket or other clothing. Thus, with continued reference to FIGS. 1-6, the pistol 10 includes an integrated, low profile sight 48, which may be comprised of a tritium sight. Another feature which prevents the pistol 10 from catching on a user's clothing is that it uses an internal hammer 62, which will be further described hereinafter, and which is fully enclosed within the frame of the pistol 10.

In accordance with the preferred embodiment of the invention, ambidextrous thumb latches 50 (See, FIGS. 1, 5, and 6) are included on each side of the pistol 10. While only the latch 50 on the left side of the pistol 10 is actually shown, the latch on the right side of the pistol 10 is identical. The design of the thumb latches 50, along with their associated mechanisms, is such that if either of them is pushed forward (toward the muzzle of the pistol 10) it will cause a receiver disconnect push pin 52 to push a receiver lockup pin 54 forward against the force of a latch retainer spring 56, thereby causing the lockup pin 54 to disengage from a barrel latch 58 formed on the underside of the barrel assembly 12 (See, FIG. 6). When the receiver lockup pin 54 is disengaged from the barrel latch 58 a barrel tip up spring 60 causes the barrel assembly 12 to rapidly tip up, as shown in FIG. 6.

When the rear of the barrel assembly 12 tips up, the spring-loaded ejector 26 forces the cartridges 28, 30 out of the breach 24 as soon as the breach 24 clears the frame. The user can then open the trap door 38 (which is held closed by a detent) and remove the cartridge loading device 42, which retains the spare cartridges 34, 36, from the cartridge trap 40 within the grip 32. While holding the tab 44, the user can quickly reload the pistol 10, tear the cartridge loading device 42 from the newly loaded cartridges 34, 36, and snap the barrel assembly 12 into its down, locked, and ready position.

As set forth above, another feature of the pistol 10 of the preferred invention is that it is designed to have an internal hammer 62 along with a smoothly joined exterior configuration whereby the likelihood of something on the pistol 10 "catching" when the pistol 10 is removed from a concealed location, e.g., from a user's pocket, is greatly reduced. With reference to FIGS. 5 and 6, the operation of the trigger 18 and associated mechanism is that when the trigger 18 is "pulled" against the force of the trigger spring 64, a trigger linkage 66 moves a sear 68 rearward along a sear guide 70 on which the sear 68 rides. The upper portion of the sear 68 presents a cam surface 72 to the pivoting hammer mechanism 62, whereby a roller bearing 74 rides up the cam surface 72, pivoting the hammer 62 rearward around a roller bearing 76 against the force of a hammer spring 78. When the sear 68 reaches a disconnect 80, the disconnect 80 is pushed rearward against the force of a disconnect spring 82 until it reaches a point where the disconnect 80 is pushed free of a disconnect block 84, at which point the sear guide 70 pivots downward about a disconnect pivot 86, clearing the roller bearing 76, and allowing the hammer 62 to be driven against firing pin assemblies 88, 90, each of which includes a firing pin which is spring loaded away from the breach until struck by the hammer 62, at which time a struck firing pin will be driven forward into a cartridge in the breach 24. In FIG. 6 the tips of the firing pins 100, 102 are shown extending out of the firing spring assemblies 88, 90 for clarity. However, the springs (not shown) within the firing spring assemblies 88, 90 would normally prevent the firing pin tips 100, 102 from extending, as they are strong enough to hold the hammer 62 somewhat back from the firing spring assemblies 88, 90.

While it is possible to have a single forward movement of the hammer 62 drive the firing pins in each of the firing pin assemblies 88, 90 into the cartridges 28, 30, in the preferred embodiment of the invention the hammer 62 has a cylindrical bore formed therein and a firing pin selector, in the shape of a cylinder is positioned within the cylindrical bore. The firing pin selector of the preferred embodiment of the invention (not shown) includes four faces, two of which have a flat portion in juxtaposition with the upper firing pin assembly 88, and two of which have a flat portion in juxtaposition with the lower firing pin assembly 90. On each of the faces of the firing pin selector, there is also a convex portion which prevents the firing pin selector from contacting the firing pin assembly 88 or 90 which is not to be struck. Firing pin indexes 92 on the firing pin selector cause the firing pin selector to rotate a quarter of a turn when they engage a yoke (not shown) each time the hammer 62 is brought back to fire the pistol 10. Thus, on each successive pull of the trigger 16, the firing pin in either the top firing pin assembly 88 or the firing pin in the bottom firing pin assembly 90, will be struck, but both will not be struck at the same time.

The use of the so-called roller bearing trigger system (so named because of the use of multiple roller bearings 74, 76) causes the trigger action to be extremely smooth.

Further features found in the preferred embodiment of the invention, which are designed to provide both strength and light weight to the pistol 10, are that the grip 32 is preferably made of a lightweight material, such as aluminum or titanium, while the barrels 20, 22 are preferably made of 416 stainless steel, as are the hammer 62 and other internal components. Titanium or aluminum alloy are preferably used to make the frame, with aluminum alloy being lighter and titanium being stronger without adding undue weight to the pistol 10.

A safety feature of the pistol 10 is that there is a space between the rear and the firing pin assemblies 88, 90 which provides a positive visual indication of whether the chamber is loaded as the rear of the cartridges are visually exposed.

As will be understood by those skilled in the art, many shooters consider the shape and size of the original and subsequent "1911" platform to be ergonomically preferred (so-called "1911 ergonomics"). Thus, the grip in the preferred embodiment of the invention angles back (from the vertical) by 17 degrees, the distance from the rear of the grip 32 (called the "back strap") to the front of the trigger 18, and the size and shape of the trigger 18 are in accordance with such 1911 ergonomics.

Yet, another feature of the preferred embodiment is that it uses progressively ported barrels which include a series of specifically designed gas venting holes 96, 98 in the barrels 20, 22. The purpose of the venting holes 96, 98 is that when the pistol 10 is discharged pressurized gases are diverted in specific directions and angles to reduce both recoil and muzzle climb.

As set forth above, the pistol 10 of the preferred embodiment includes a pivoting retaining member 14 which is used to attach the receiver 12 to the pistol 10. In the preferred embodiment of the invention, the pivoting retaining member 14, which may be in the form of a movable pin, or other suitable form allows the pistol to utilize interchangeable receivers 12, whereby the superposed double barrel receiver 12 is interchangeable to multiple calibers utilizing the same frame. By way of example, receivers including barrels for available calibers could include .22 caliber, 22mag, 22hornet, 5.7×28 mm, .25 mm, .380, 9 mm, 10 mm, .40 S&W, .38 Special, .357 Magnum, .410, 45 ACP, 45 Long Colt, 44 Magnum, 50 S&W Magnum, or such other calibers as may be available or desired without departing from the present invention.

While the preferred embodiment of the invention has been described and illustrated, those skilled in the art will recognize that numerous variations of the present invention can be made without departing from the spirit of scope of the invention described and claimed. By way of one example, while a two barrel over/under configuration has been described, it is possible for there to be more than two barrels or for the configuration to be other than an over/under configuration. Thus, it would be within the scope of the invention to have a side-by-side configuration, a dual side-by-side configuration with one pair of barrels being in an over/under relationship with a second pair of barrels, or even a three barrel configuration in which the axes of the three barrels are parallel, but not necessarily in-line, i.e., in which they have a triangular juxtaposition.

I claim:

1. A multi-shot pistol comprising:

a. a body, said body including an integral grip, said integral grip including storage space for receiving and retaining spare cartridges;

b. a barrel assembly having multiple barrels;

c. means for pivotally attaching said barrel assembly to said body;

d. a trigger assembly, said trigger assembly including a single trigger attached to the front of said integral grip, said trigger underlying said barrel assembly, said trigger assembly further including at least two firing pins, and a linkage to means for causing an internal hammer to strike said at least two firing pins.

2. The multi-shot pistol of claim 1 wherein said means for pivotally attaching said barrel assembly to said body includes a movable pin.

3. The multi-shot pistol of claim 2 wherein said movable pin is adapted to provide attachment of barrel assemblies adapted for use with different caliber cartridges.

4. The multi-shot pistol of claim 3 wherein said different caliber cartridges are selected from the group consisting of .22 caliber, .22 Mag, .22 Hornet, 5.7×28 mm, .25 mm, .380, 9 mm, 10 mm, .40 S&W, .38 Special, .357 Magnum, .410, 45 ACP, 45 Long Colt, 44 Magnum, 50 S&W Magnum cartridges.

5. The multi-shot pistol of claim 4 wherein said barrel assembly includes two barrels in an over/under configuration.

6. The multi-shot pistol of claim 1 wherein said body further includes at least one latch slideably mounted on said grip, said latch being connected to said means for pivotally attaching said barrel assembly to said body, means for pivotally attaching said barrel assembly to said body including a spring, whereby moving said latch causes said spring and said means for pivotally attaching said barrel assembly to said body to cause said barrel assembly to rapidly tilt upward.

7. The multi-shot pistol of claim 6 further comprising ejector means for ejecting cartridges from said barrel assembly.

8. The multi-shot pistol of claim 7 wherein said barrel assembly includes two barrels.

9. The multi-shot pistol of claim 8 wherein said two barrels have an over/under configuration.

10. The multi-shot pistol of claim 7 wherein said ejector means is spring loaded, whereby when said latch is used to cause said barrel assembly to tilt up, said ejector means will quickly and automatically cause any cartridges in said barrel assembly to be ejected therefrom.

11. The multi-shot pistol of claim 1 wherein said integral grip is machine processed to provide a pattern or design which emulates a texture which may include designs or logos.

12. The multi-shot pistol of claim 1 further comprising cartridge holding means for holding said spare cartridges within said storage space, wherein said cartridge holding means holds said spare cartridges in the same juxtaposition as is required to place them into said barrels in said barrel assembly.

13. The multi-shot pistol of claim 12 wherein said cartridge holding means for is adapted to grip said spare cartridges from the rear, whereby said spare cartridges can be readily inserted into the rear of said barrels without removing said cartridge holding means.

14. The multi-shot pistol of claim 13 wherein said cartridge holding means is adapted to be readily removed from said spare cartridges when said spare cartridges are inserted into the rear of said barrels.

* * * * *

UNITED STATES PATENT AND TRADEMARK OFFICE
Certificate

Patent No. 8,495,831 B1 Patented: July 30, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Raymond B. Kohout, Lake Ozark, MO (US); and Charles K. Heizer, St. Louis, MO (US).

Signed and Sealed this Eighteenth Day of November 2014.

TIMOTHY D. COLLINS
*Supervisory Patent Examiner*
Art Unit 3644
Technology Center 3600